US006978947B2

(12) United States Patent
Jin

(10) Patent No.: US 6,978,947 B2
(45) Date of Patent: Dec. 27, 2005

(54) AEROSOL SPRAY CONTAINER WITH TIME DELAYED RELEASE ACTUATOR

(76) Inventor: Xianyang Jin, 301 Bing Building, Block No. 6, Xincun, Yuanfengqiao, Changzhou 213003, Jiangsu Province (CN)

( * ) Notice: Subject to any disclaimer, the term of this patent is extended or adjusted under 35 U.S.C. 154(b) by 21 days.

(21) Appl. No.: 10/791,236

(22) Filed: Mar. 2, 2004

(65) Prior Publication Data

US 2005/0077387 A1 Apr. 14, 2005

(30) Foreign Application Priority Data

Oct. 8, 2003 (CN) ..... 2003201000877

(51) Int. Cl.[7] ..... F23D 14/34
(52) U.S. Cl. ..... 239/337; 239/340; 239/344; 239/373; 222/402.13
(58) Field of Search ..... 239/337, 340, 239/344, 373; 222/402.13, 402.14–15, 477, 222/476, 212, 207

(56) References Cited

U.S. PATENT DOCUMENTS 3,788,550 A * 1/1974 Nishiguchi et al. ..... 239/337
4,142,652 A * 3/1979 Platt ..... 222/402.2
5,702,036 A 12/1997 Ferrara, Jr.
6,241,131 B1 6/2001 Katsuda et al.

FOREIGN PATENT DOCUMENTS

EP 0 220 132 A2 4/1987

* cited by examiner

*Primary Examiner*—David A. Scherbel
*Assistant Examiner*—Thach H. Bui
(74) *Attorney, Agent, or Firm*—Akin Gump Strauss Hauer & Feld, LLP

(57) ABSTRACT

The present invention provides an aerosol spray container comprising: a container main body to contain the contents, a valve means provided on the top of the main body, and a cap means. Within the cap means, a control pressing lever means being connected with the cap means at one of its end covers onto the valve, a control pressing lever means being connected with the cap means at one of its end covers onto the valve, an actuation button means is connected with another end of the pressing lever through a spring means There are two protrusions provided on the cap means and two recesses provided on the button means, the protrusions and recesses are engaged so that the button can slide downwardly. A locking device is provided on a designed portion of the protrusions and recesses to lock the button. A time delayed device closely under the said another end of the pressing lever is arranged to extend the time during the period that the pressing lever moves downwardly. An actuator is provided under the tail end of the button, used to initiate the delay device when the button is pressed downwardly. By using the time delayed actuator according to present invention, the time can be effectively delayed after the button 2 is pressed and before the aerosol begins to release.

8 Claims, 3 Drawing Sheets

AEROSOL SPRAY CONTAINER WITH TIME DELAYED RELEASE ACTUATOR

BACKGROUND OF THE INVENTION

The present invention relates to an aerosol spray container, and more particularly, to an aerosol spray container with time delayed release actuator.

Currently, a consumption of an aerosol insecticide spray container of miniature for hotels, dwelling house, etc. is continuously increasing. When using such kind of spray container, instead of pressing a valve means of the spray container again and again, a user only needs to press the valve means down once before he (or she) leaves the room, then the valve means is locked on a start position. The valve means can't move back anymore, consequently, the aerosol is totally released from the valve. In this way, people can finish the whole spray process. When they return to the house, what they need to do is just to open the windows to air the room. Certainly, this aerosol spray container is convenient for the user. However, when using the aerosol spray container, the user has to rush out of the room in a hurry as soon as the valve means is pressed down so as to avoid breathing the spray in the air, especially when the aerosol has unpleasant odors.

Therefore, an aerosol spray container with a time delayed release actuator is required to overcome the aforesaid disadvantages.

BRIEF SUMMARY OF THE INVENTION

An object of the present invention is to provide an aerosol spray container with time delayed release actuator, by which the aerosol can be delayed to release, and what's more, the time delayed can be controlled.

To achieve the above-mentioned object, an aerosol spray container with time delayed release actuator is provided by the present invention. In a preferred embodiment, the aerosol spray container with time delayed release actuator comprises: a container main body to contain the contents, a valve means defined on a top of the main body and a cap means provided on the top of the main body and almost having the valve means enclosed. Within the cap means, a control pressing lever means being connected with the cap means at one of its end mates with the valve, a control pressing lever means being connected with the cap means at one of its end mates with the valve, an actuation button means is connected with another end of the pressing lever through a spring means so as to press the pressing lever means. There are two protrusions defined on the cap means and two recesses defined on the button means for engaging with the protrusions correspondingly. Therefore, the button can slide downwardly with a guide provided by the engagement of the protrusions and the recesses. A locking device is provided on a determined portion of the protrusions and recesses to lock the button means. A time delayed device closely under the said another end of the pressing lever is arranged to extend the time during the period that the pressing lever moves downwardly. An actuator is provided under a tail end of the button, used to initiate the delay device when the button is pressed downwardly.

A spring is provided in a chamber of the button means, with its upper end pushing against the top of the chamber and its lower end pressing against a projecting portion of another end of the pressing lever. The projecting portion is hollow inside, and an aperture to allow the time delayed device to pass through is formed at a center of the projecting portion.

In the middle part of the pressing lever, there are three concentric holes provided, i.e. the biggest hole mating with the valve, the smallest one through which the aerosol releases out, and the other one as a transitional hole.

The time delayed device can be a capsule containing liquid to perform damping function, and the actuator is a needle which could pierce the capsule.

A longitudinal flute is provided on the needle to lead the liquid out.

The capsule is a sealed bag which is made of soft material and stores up liquid inside.

The principle used in the present invention is that the flow velocity of the liquid differs under different damping situation. Therefore, the performance of the controllable damping also makes the delayed time controllable. Therefore, the aerosol spray container according to present invention can perform the delayed total release of the aerosol by its simple structure and with its low price.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Reference will now be made to the drawings to describe the present invention in details. In each drawing, only the top part of the container is shown since a container main body is usually in common design.

Figure 1:
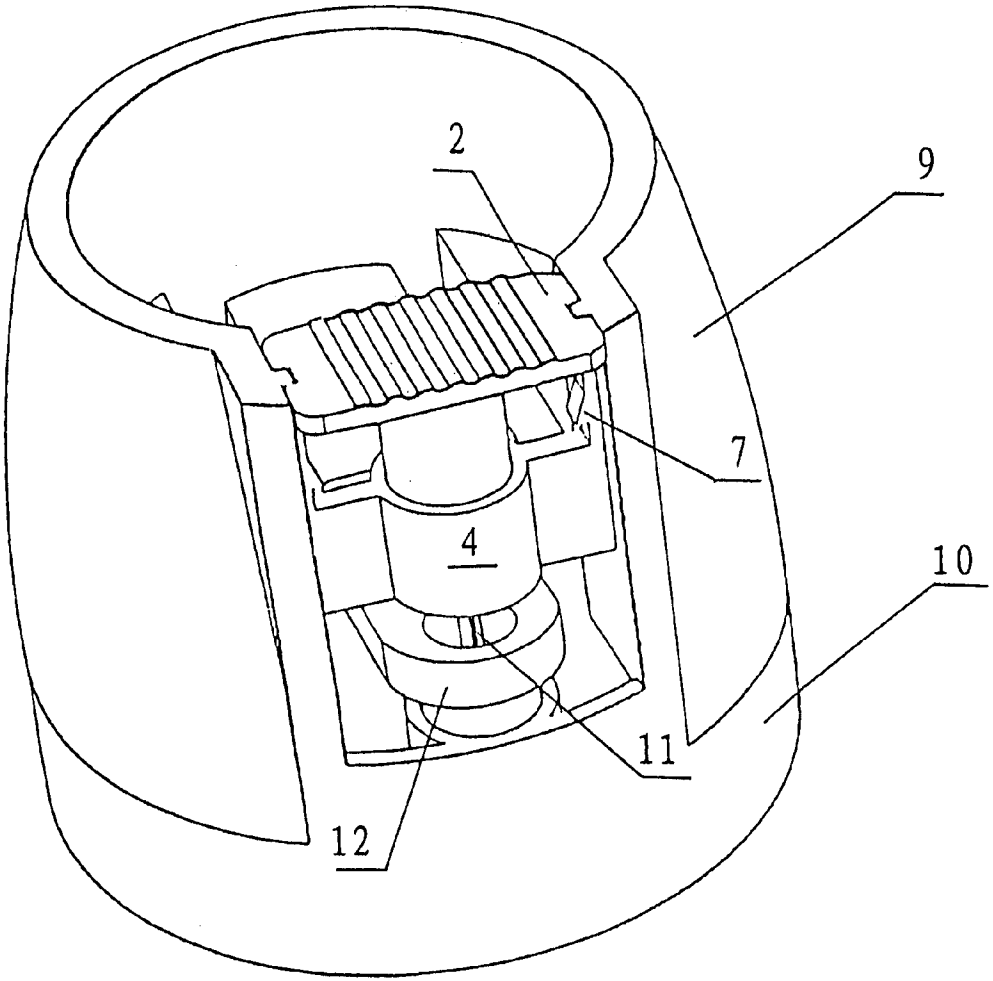
FIG. 1 is a perspective view of a top part of the spray container with a preferred embodiment of the present invention, showing the relationships with every part of the spray container.
Figure 2:
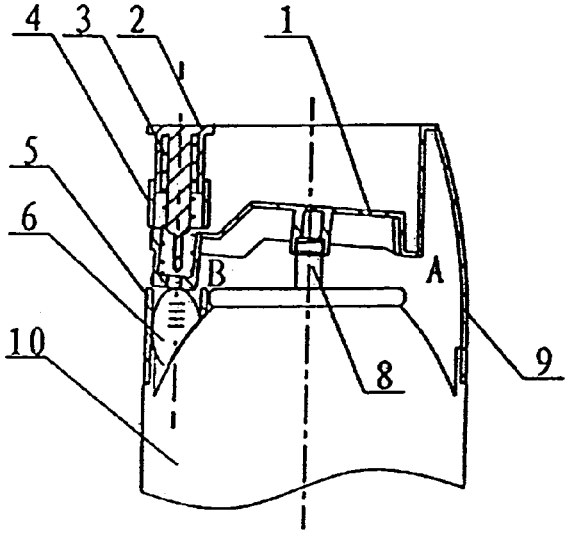
FIG. 2 is a sectional view of a time delayed release actuator, showing a state of a control pressing lever before it is pressed down.
Figure 3:
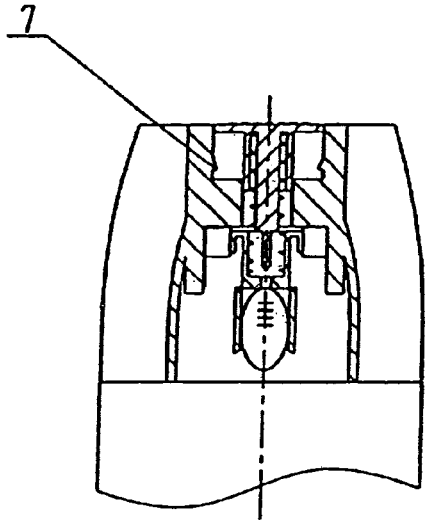
FIG. 3 is another sectional view of the time delayed release actuator in FIG. 1 from side view.
Figure 4:
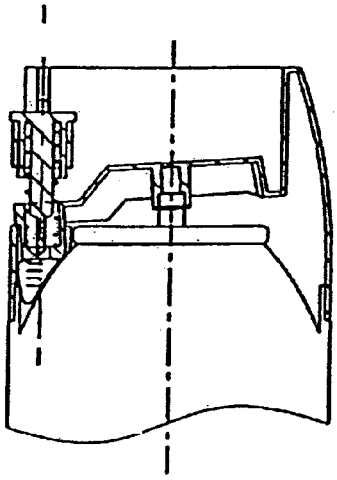
FIG. 4 is another sectional view of the time delayed release actuator when the aerosol is being released.
Figure 5:
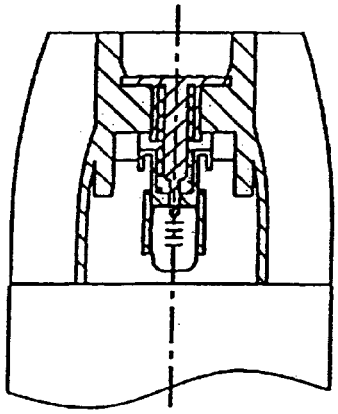
FIG. 5 is another sectional view of the time delayed release actuator in FIG. 4 from the side view.
Figure 6:
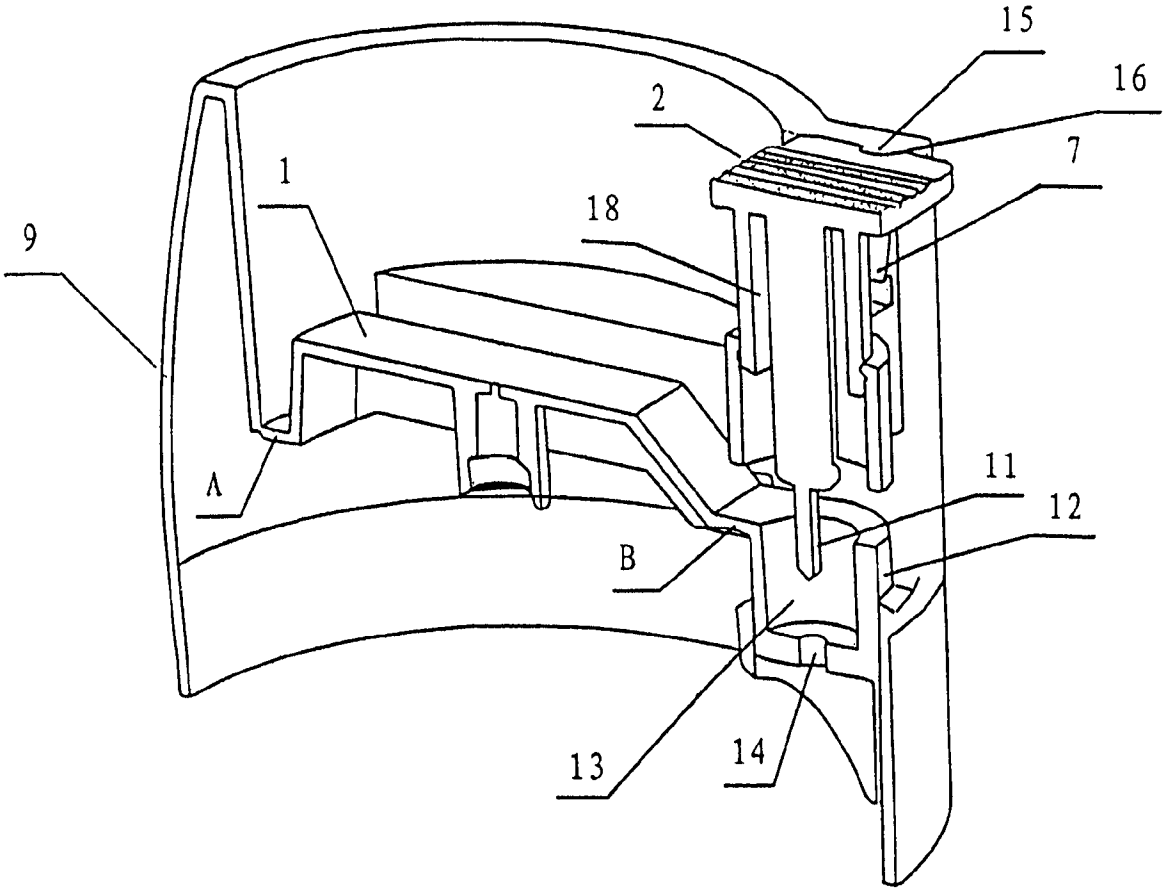
FIG. 6 is a sectional view of the container, a sketch drawing showing the structure without the button means.

As shown in FIG. 1 and FIG. 2, the aerosol spray container according to present invention usually comprises a container main body 10 and a cap 9 that covers the container main body 10. The cap 9 is made of elastic material. A valve 8 is provided on the top of the container 10, through which the contents inside the container main body 10 are released.

A pressing lever 1 is set inside the cap 9. The pressing lever 1 is made of rigid material, such as steel or rigid plastic. One end A of the pressing lever 1, being connected to the cap 9, functions as a fulcrum. There are three concentric holes in the middle part of the pressing lever 1, the big one mates with the valve 8, the small one through which the aerosol is released out and the other one is a transitional hole. Another end B of the pressing lever performs as a lever that may moves upwardly and downwardly around the end A. In this way, the pressing lever 1 will rotate around the end A when its end B is pressed downwardly, and the valve 8 is thereby pressed downwardly to release the contents inside the spray container 10.

According to the invention, at the end B of the pressing lever 1, a columned projecting portion 12 with a circle hole 13 in the middle and a small hole 14 at the bottom. Under the projecting portion 12, a time delayed device 6 is provided in a chamber 5.

According to a preferred embodiment of the present invention, time delayed device 6 is a capsule, a sealed bag which is made of soft material and stores up liquid inside. It is placed in a capsule seat, i.e. chamber 5, which is connected with the cap 9. As indicated in FIG. 2, the capsule 6 is set within chamber 5, with its up surface against the bottom of the projection portion 12 and its bottom surface against the arc cap 9 of the container 10.

As shown both in FIG. 1 and in FIG. 2, the button 2 is a cylinder with a cavity 18 formed near its top to receive a spring means 3. The tail end of the button 2 defines an actuator, used to initiate the time delayed device. According to the preferred embodiment of the present invention, the actuator is a needle 11 with a longitudinal flute (not shown) to lead the liquid out.

The spring 3 is provided with its one end set within the cavity 18 of the button 2 and another end extending into the circle hole 13 of the projecting portion 12. The circle hole 13 acts as a spring base and the hole 14 is used to allow the needle of the button 2 to pass through. Under the top of the button 2, there is a guide sleeve 4 fixed to the cap 9, within which a part of the button 2 is guided to move downwardly.

A guiding means is provided at the portions where the cap 9 is engaged with the button 2. According to an embodiment of the present invention, there are two protrusions 15 provided on the cap 9 and two corresponding recesses 16 provided on the button 2. According to another embodiment, however, the protrusions and recesses could be arranged inversely. Additionally, a flange (not shown) is provided on an inside surface of the upper portion of the guide sleeve 4 and on an outside surface of the lower portion of the cylinder of button 2, a raised portion (not shown) is provided to engage with the flange of guide sleeve 4, so as to prevent the spring means 3 from ejecting the button 2 out.

A clamp means 7 is provided on a predetermined portion on the guiding protrusions 15 and above the guide sleeve 4. In this way, when the button 2 moves downwardly to a certain position, the clamp means 7 then engaging with certain portion of the button 2 so as to lock the button 2 and prevent it from returning upwardly to its original position.

According to the present invention, the spring 3 is set within the cavity 18 formed between the cylinder of button 2 and the cap 9. Before the button 2 is pressed, the spring means 3 is under a situation far from fully pressurized, with its two ends respectively against the top of the button 2 and the spring seat 13 of the end B of the pressing lever 1.

When using the container 10, the button 2 is firstly pressed downwardly to pressurize the spring 3 between the button 2 and the end B of the pressing lever 1. When the button 2 moves downwardly along the guide sleeve 4 to a predetermined position, it is locked by the clamp 7 and can not return to its original position. According to an embodiment of the present invention, the clamp 7 is an elastic agnail and it locks the button on the top.

The end B of the pressing lever 1 can't continuously move downwardly due to the capsule 6 is beneath it. So, the power from the spring 3 is reserved between the button 2 and the end B of the pressing lever 1.

At the moment that the button 2 is pressed down, the needle 11 moves downwardly through the hole 14 and pierces into the capsule 6, breaking the upper portion of the sealed capsule with a pinhole. Since the needle 11 jams the pinhole, instead of flowing out of the capsule 6 immediately, the liquid inside the capsule 6 is slowly discharged along the flute of the needle 11. Forced by the spring 3, the end B of the pressing lever 1 moves downwardly to press the capsule 6, continuously extruding the liquid out along the flute of the needle 11. The flow velocity of the liquid can be adjusted by changing the damp applied to he liquid.

With the liquid flowing out of the capsule 6, the end B of the pressing lever 1 continuously moves downwardly under the application of spring 3. When the middle portion of the pressing lever 1 moves downwardly to make the valve 8 on the release position, the contents begins to spray out from the valve 8.

By using the time delayed actuator according to present invention, the time can be effectively delayed after the button 2 is pressed and before the aerosol begins to release. According to this invention, the time delayed can be controlled via controlling the type of the liquid, the intensity of the spring, the depth of the longitudinal flute, the quantity of the liquid and others alike. The liquid is a mixture composed of water and dope respectively in certain proportions and also may comprise antifreeze in certain proportion.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An aerosol spray container, comprising:

a container main body (10) to contain the contents;

a valve (8) provided on a top of the main body;

a cap (9) provided on the top of the main body;

a pressing lever (1) being connected with the cap (9) and at one of its end (A) being connected to the valve (8);

an actuation button (2) is connected with another end (B) of the pressing lever (1) through a spring (3) to press the pressing lever (1) downwardly;

protrusions (15) and corresponding recesses (16) are respectively provided on the cap (9) and button (2) to guide the button (2) to slide downwardly;

a locking device (7) is provided on a predetermined portion of the protrusions (15) and recesses (16) to lock the button (2);

a time delayed device (6) is arranged immediately under the said another end (B) of the pressing lever (1) to extend the time during the period that the pressing lever (1) moves downwardly; and an actuator (11) is provided under a lower end of the button (2), used to initiate the delay device (6) when the button (2) is pressed downwardly.

2. An aerosol spray container according to claim 1, wherein the spring (3) is provided in a chamber (18) of the button (2), with its upper end pushing against the top of the chamber (18) and its lower end pressing against a projecting portion (12) of the another end (B), a circle hole (13) is provided in the middle of the projecting portion (12), and at the center of the bottom of the projecting portion (12) an aperture (14) is defined to allow the actuator (11) to pass through.

3. An aerosol spray container according to claim 1, wherein three concentric holes are provided in the middle part of the pressing lever (1), wherein the biggest hole mating with the valve (8), the smallest one through which the aerosol releases out, and the other one as a transitional hole.

4. An aerosol spray container according to claim 1, wherein the time delayed device (6) is a capsule containing liquid to perform damping function, and the actuator (11) is a needle with a sharp end which can pierce the capsule.

5. An aerosol spray container according to claim 4, wherein a longitudinal flute is defined on the needle to lead the liquid out.

6. An aerosol spray container according to claim 1, wherein the capsule (6) is a sealed bag which is made of soft material and stores up liquid inside.

7. An aerosol spray container according to claim 6, wherein the liquid is a mixture composed of water and dope respectively in certain proportions.

8. An aerosol spray container according to claim 7, wherein the liquid may comprise antifreeze in certain proportion.

* * * * *